US005871660A

United States Patent [19]

Xu et al.

[11] Patent Number: 5,871,660

[45] Date of Patent: Feb. 16, 1999

[54] LIQUID METAL DELIVERY SYSTEM FOR CONTINUOUS CASTING

[75] Inventors: Dong Xu, Milpitas; James W. Evans, Piedmont, both of Calif.

[73] Assignee: The Regents of the University of California, Oakland, Calif.

[21] Appl. No.: 824,402

[22] Filed: Mar. 26, 1997

[51] Int. Cl.[6] ..... B22D 41/00

[52] U.S. Cl. ..... 222/594; 222/606

[58] Field of Search ..... 222/594, 606, 222/607; 164/337, 437, 489

[56] References Cited

U.S. PATENT DOCUMENTS

| | | | |
|---|---|---|---|
| 2,757,425 | 8/1956 | Duncan et al. . | |
| 2,876,509 | 3/1959 | Gardner . | |
| 3,517,726 | 6/1970 | Mills et al. | 164/437 |
| 3,578,064 | 5/1971 | Mills et al. | 164/489 |
| 3,779,389 | 12/1973 | Fant . | |
| 4,202,397 | 5/1980 | Hlinka et al. | 164/437 |
| 4,576,219 | 3/1986 | Uram . | |
| 5,244,032 | 9/1993 | Bankaden et al. . | |

OTHER PUBLICATIONS

C. Raffourt, et al., "Liquid Metal Distribution in a Slab DC Casting: Experiments and Modelling Approach," *Light Metals 1991* The Minerals, Metals & Materials Society (Dec. 1990) pp. 877–882.

C.J. Paradies et al., "Dendrite Frangmentation by Forced Flow Over the Mushy Zone," *Light Metals Dec. 1992* The Minerals, Metals & Materials Society (1991) pp. 1015–1019.

C.J. Paradies, et al., "Effects of Mixed Convection of Dendrite Fragmentation During Alloy Solidification," *Transport Phenomena in Solidification* ASME (Dec. 1994) HTD–vol. 284/AMD–vol. 182, pp. 161–169.

H. Fredriksson, et al., "The Effect of Stirring on the Solidification Process in Metals," *Scandinavian Journal of Metallurgy* (Dec. 1986) 15: 127–137.

K.A. Jackson, et al., "On the Origin of the Equiaxed Zone in Castings," *Tranactions of the Metallurgical Society of AIME* (Jan.–Jun. 1996) 236: 149–158.

*Primary Examiner*—Scott Kastler
*Attorney, Agent, or Firm*—Townsend and Townsend and Crew LLP

[57] ABSTRACT

Molten metal is fed to a caster in a continuous casting operation through a distributor that divides the molten metal into four streams flowing in circulating patterns from the central axis of the caster. Each stream sweeps first along the longer side wall of the caster toward the corner, then back along the shorter side wall toward the center line. The result is a higher degree of fragmentation of metal crystals as they form, and a better distribution of the fragments across the caster cross section, as well as a more even temperature distribution.

20 Claims, 14 Drawing Sheets

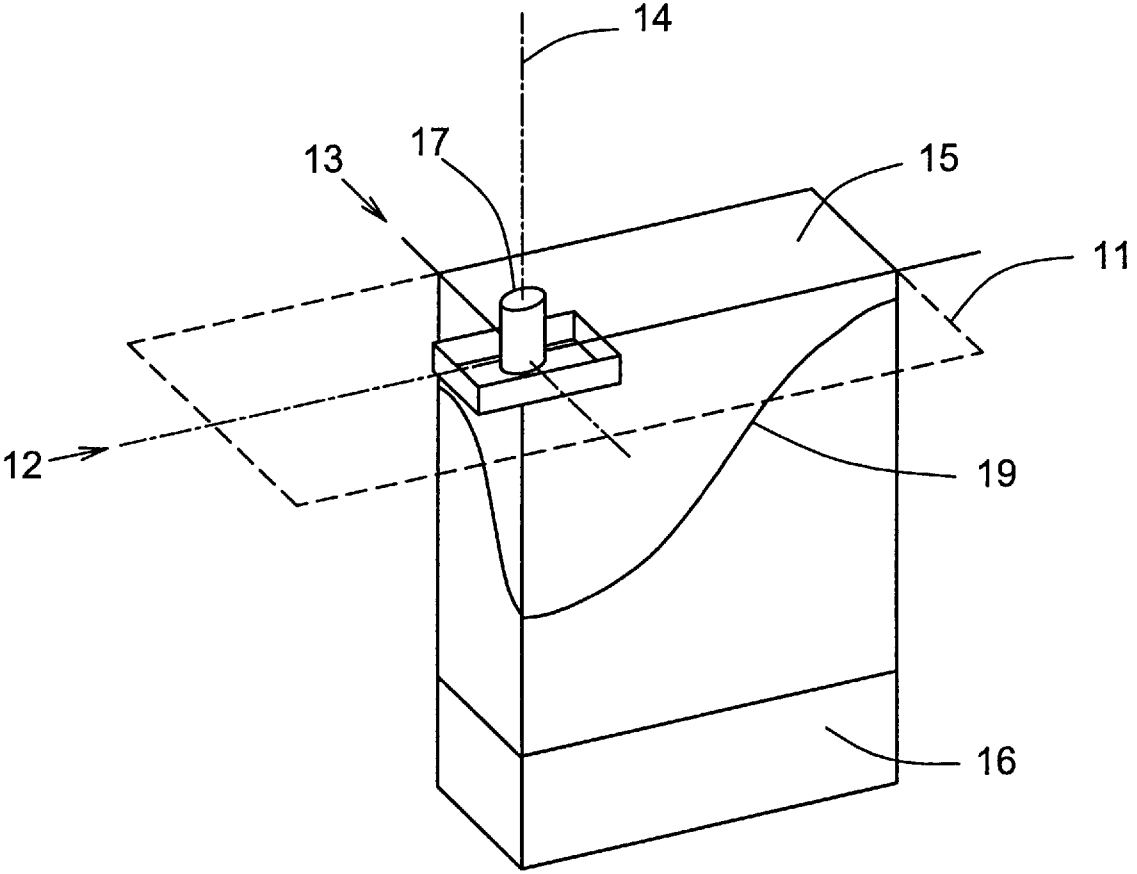
Fig. 1a - Prior Art

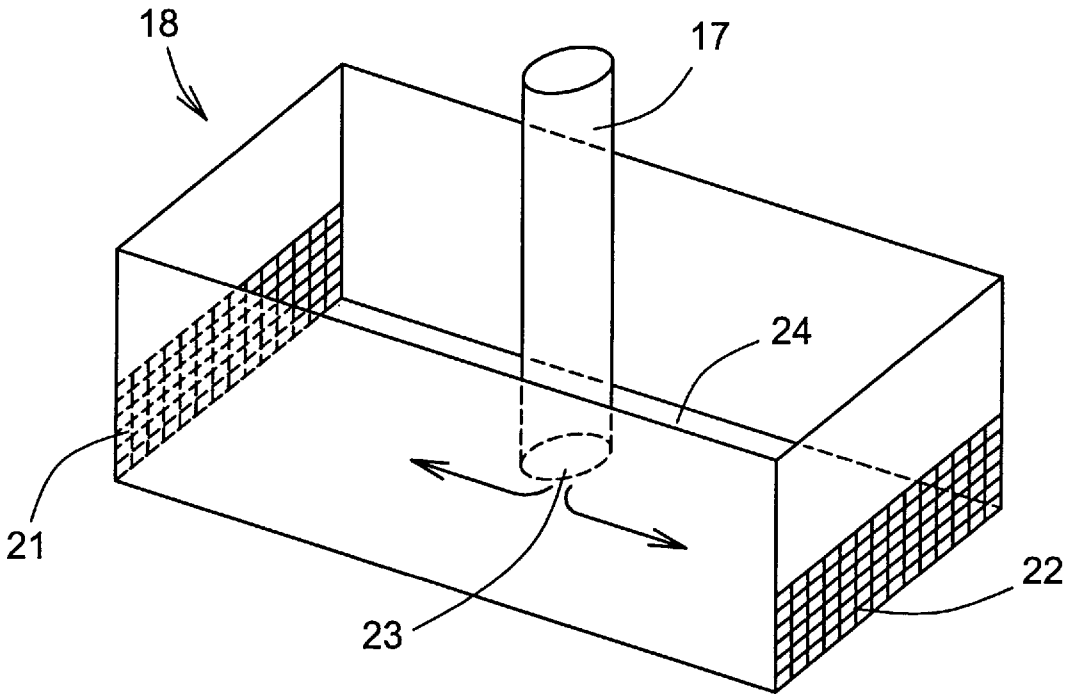
Fig. 1b - Prior Art

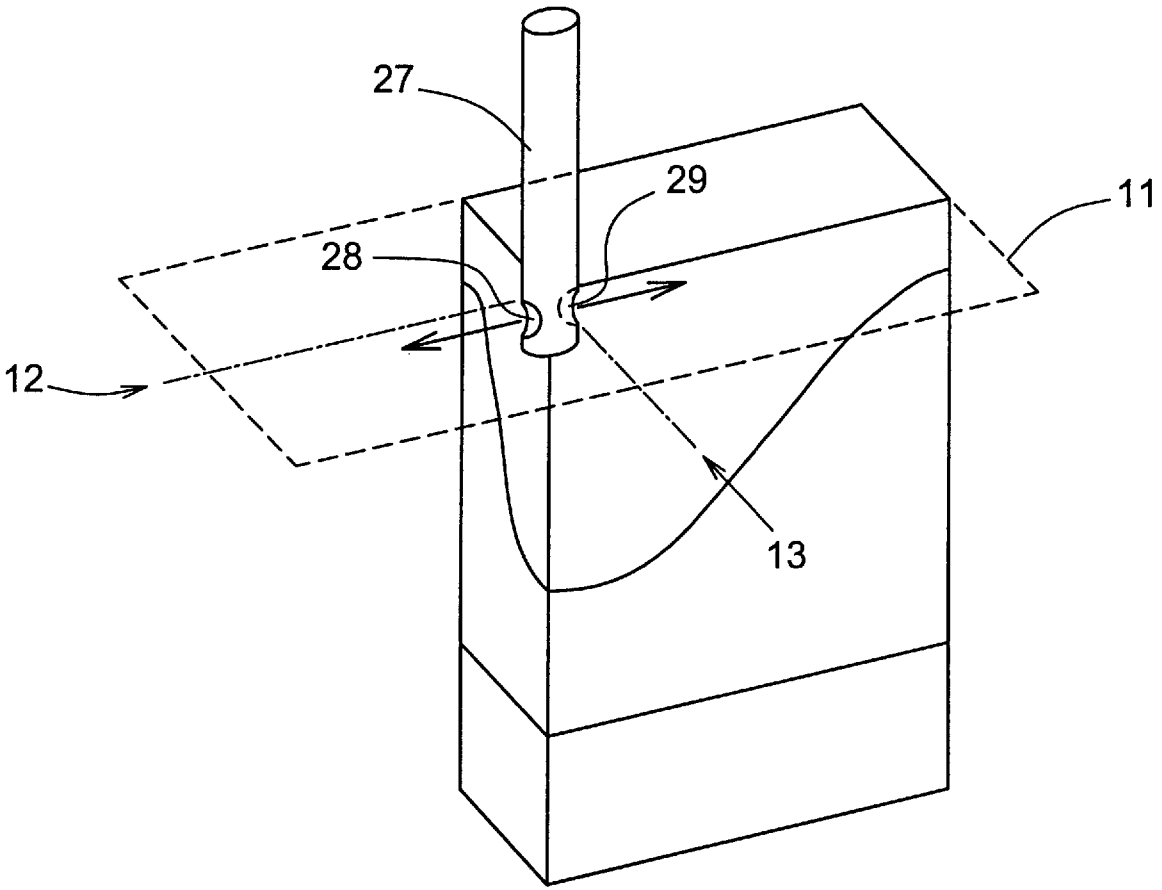
Fig. 2 - Prior Art

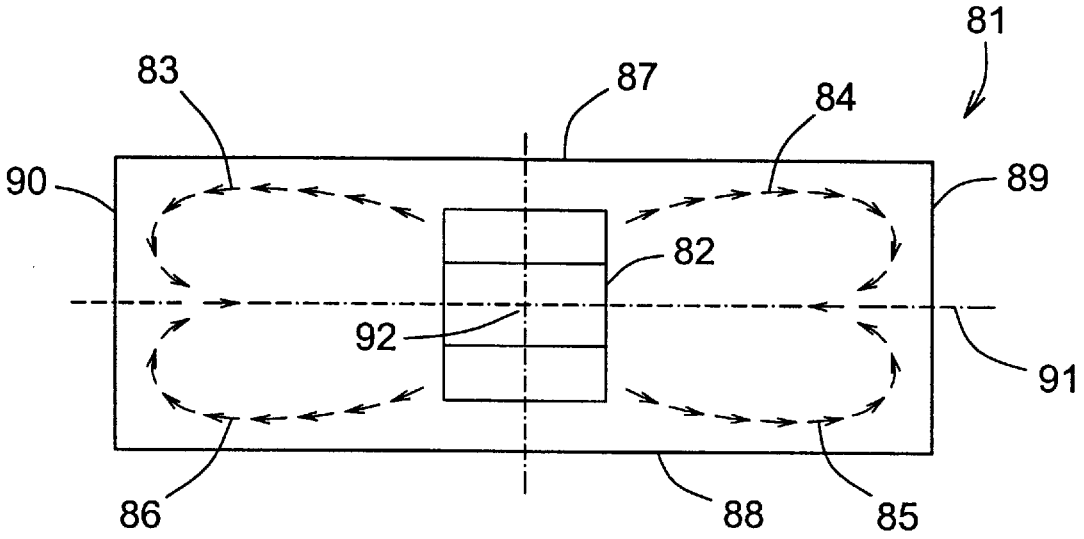
Fig. 11a
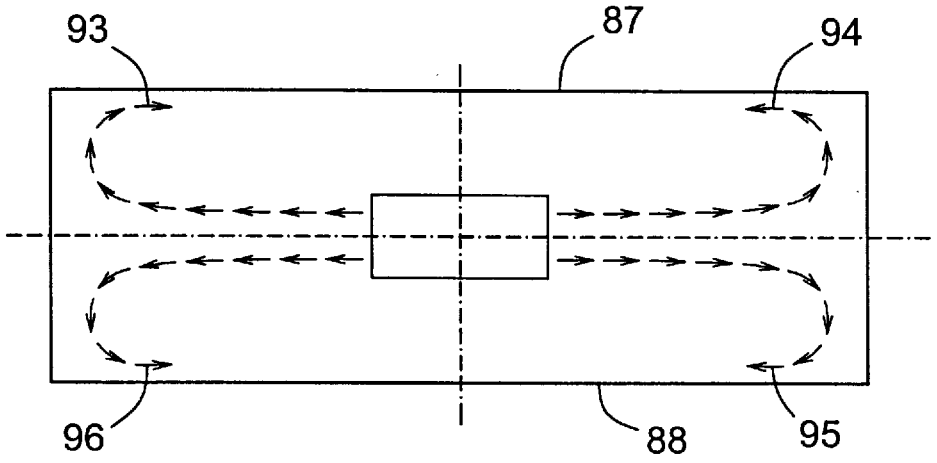
Fig. 11b - Prior Art

LIQUID METAL DELIVERY SYSTEM FOR CONTINUOUS CASTING

BACKGROUND OF THE INVENTION

1. Field of the Invention

This invention relates to methods and equipment for continuous or semi-continuous casting of metals.

2. Description of the Prior Art

Continuous casting, or semi-continuous casting as it is frequently referred to in the aluminum industry, is a method used for casting metals such as aluminum and steel from molten metal. The advantages of continuous casting include a relatively low expense and a higher yield than ingot casting, as well as the ability to directly form slabs that would otherwise have to be formed from ingots by rolling. Two methods of continuous casting are used in the aluminum industry—direct chill (DC) casting and electromagnetic (EM) casting, the former using a water-cooled mold to contain the molten metal as it solidifies, and the latter using an electromagnetic field for the same purpose and eliminating some of the surface defects that arise in DC casting.

In either of these methods, the cast metal moves continuously downward while molten metal is continuously fed to the top of the apparatus. To achieve efficient cooling of the metal, the incoming molten metal is directed by nozzles or distributors to flow in a horizontal direction toward the shorter sides of the mold where the cooling rate is greater.

A typical caster and distributor for aluminum casting is shown in FIGS. 1*a* and 1*b*. FIG. 1*a* shows the horizontal cross section of the caster in dashed lines 11. The cross section is divided into quadrants by two orthogonal bisecting panes 12, 13, that intersect at the vertical axis 14 of the caster. One of the quadrants 15 is shown in solid lines. At the base of this quadrant is the bottom block 16 which supports the aluminum that has already solidified. Molten aluminum is fed to the caster at its top center through a nozzle 17 and distributor bag 18, and cooling of the molten aluminum occurs through the side walls of the caster, forming a solidification front 19.

FIG. 1*b* is an enlargement of the nozzle 17 and distributor bag 18. The distributor bag is an open-top receptacle whose sides and base are formed of closely woven ceramic or heat resistant fabric that is virtually impermeable to aluminum at the pressure differentials encountered in the metal pool. Its two short sides, however, which are parallel to the two short sides of the casting mold, contain windows 21, 22 where a fabric of a much more open weave is used. The lower end 23 of the nozzle 17 is open and terminates above the base 24 of the bag, allowing the molten metal to flow from the nozzle to the windows and out of the bag.

A typical caster and nozzle for steel casting is shown in FIG. 2, which presents a view identical to that of FIG. 1*a*, including the full cross section shown in dashed lines 11 and the two orthogonal bisecting planes 12, 13. Distribution of the molten steel, however, is achieved by a cylindrical nozzle 27 or "shroud" without a bag, since ceramic fabric bags are not functional at the high temperatures required for molten steel. Unlike the nozzle used in aluminum casting, the steel distributor nozzle is closed at the bottom and contains two lateral holes 28, 29 at opposite sides of the cylindrical wall close to the closed bottom. Both the windows 12, 13 in the aluminum distributor bag and the two holes 28, 29 in the steel nozzle are intended to direct the flow of the incoming molten metal toward the two short sides of the casting mold, where the cooling rate is greater. The goal is a uniform temperature gradient and solidification rate along the perimeter of the mold. This minimizes solidification defects such as segregation and coarse-grained regions or "cold shuts," and yields better quality castings.

With either type of distributor, however, the metal solidifies in the mold in three regimes, located in segregated regions in the transverse cross section of the cast metal. These are the chill zone located near the mold wall, the columnar zone defined by dendrites that extend inward from the chill zone, and the equiaxed zone surrounding the central axis of the mold. In the equiaxed zone, the grains are closest to being isometric, i.e., equal in dimension along all three axes, and are usually more fine-grained. Studies have shown that the equiaxed zone can be expanded and the grain size decreased by increasing the rate of agitation of the metal as it solidifies. This is desirable because it facilitates subsequent processing of the cast metal. The time needed to homogenize the metal by annealing, for example, is reduced, and rolling of the metal is easier and produces a more uniform product.

The generally accepted explanation of why agitation is successful in yielding a smaller grain size and a larger equiaxed zone is the "fragmentation" of dendrites growing at the solidification front. Fragmentation, or the detachment of dendrite arms from the dendrites, results from fluctuations in the temperature of liquid adjacent to the dendrites, or in the concentration of the liquid, which lowers the local melting point. Once detached, the fragments are swept to other regions of the melt by the flow, where they serve as nuclei for the formation of grains as solidification proceeds.

In the steel industry, agitation during casting is frequently imposed by electromagnetic stirring, which involves the imposition of electromagnetic stirring forces on the melt by a low frequency power supply and inductor. Electromagnetic stirring is costly, however, due to the significant investment associated with the power supply and inductor plus the cost of electricity. Furthermore, because of technical difficulties in imposing electromagnetic stirring at the level of the mold, the stirring is usually applied below the mold. In fact, attempts have been made to reduce the force of the jets of metal flowing from the nozzle holes 28, 29 (FIG. 2) by electromagnetic braking.

In the aluminum industry, electromagnetic casting causes electromagnetic stirring to occur in the metal pool, but only in the few millimeters at the periphery of the liquid pool, whose width is typically of the order of 1 meter. This therefore has little influence on the structure of the cast metal. The main method to date for improving grain structure in the aluminum industry, in either direct chill or electromagnetic casting, has been the addition of "grain refiners" which are chemical compounds (such as titanium diboride, for example) that form nuclei for the solidifying grains. Grain refiners add to the cost of the process, however, and they raise the impurity level of the finished metal.

There remains a need to improve the quality of the cast metal by increasing the size of the equiaxed zone and decreasing the grain size in the zone, as well as by avoiding casting defects such as cracks. These and other problems encountered in the prior art are addressed by the present invention.

SUMMARY OF THE INVENTION

The present invention resides in an apparatus and method for improving the delivery and distribution of incoming molten metal to the caster in a continuous casting operation. The term "continuous casting" will be used in this specification to include "semi-continuous casting" as the latter term is used in the industry. In accordance with this invention, the molten metal is divided into four horizontal streams rather than two, and each stream is directed from the central axis of the caster along one of the longitudinal side walls of the caster toward one of the short side walls, then along the short wall to the central bisecting plane of the caster where it returns toward the center. Each stream thus follows a circulating flow pattern, with one such flow pattern occupying each of the four quadrants of the caster cross section. The circulation carries each stream first along the longitudinal walls, or along the solidification front along these walls, then back toward the center of the caster. By following this flow pattern, the stream causes fragmentation of dendrites growing inward from the caster walls and then distributes the fragments in the liquid pool, thereby producing more nuclei for crystal growth and distributing them across the cross section of the pool. The flow of hot metal toward the corners of the caster is also improved, compensating for the high cooling rate at the corners and making the liquid pool more uniform in temperature.

Preferred embodiments of the invention contain certain additional features, such as providing the streams with an elongated cross section, and orienting the streams so that the elongate axis of the cross section is angled, both features serving to improve the ability of the stream to sweep the solidification front. Other embodiments direct the streams toward the corners of the caster to achieve a temperature distribution that more closely approaches uniformity. Still further embodiments include streams directed downward below the plane of the horizontal streams.

Details of these and still other embodiments of the invention will be apparent from the description that follows.

BRIEF DESCRIPTION OF THE DRAWINGS

FIGS. 1*a* and 1*b* are representations of a prior art construction for continuous casting of aluminum. Both are perspective views.

FIG. 2 is a representation of a prior art construction for continuous casting of steel, in a perspective view.

FIG. 11*a* is a cross section of a caster and distributor in accordance with this invention, showing the molten metal flow patterns. FIG. 11*b* is a cross section of a caster and distributor of the prior art, showing the molten metal flow patterns.

DETAILED DESCRIPTION OF THE INVENTION AND PREFERRED EMBODIMENTS

Circulating flow patterns are formed by using a distributor that contains four outlets directing the flow of molten metal outward in a common horizontal plane, into each of the four quadrants and in directions symmetrically arranged relative to both bisecting planes. The flows are either parallel to the longer 12 of the two bisecting planes or directed at an angle away from this plane to more closely approach the corner of the caster. Several different embodiments of this flow arrangement and of the distributor itself are shown in the succeeding drawings.

Figure 3:
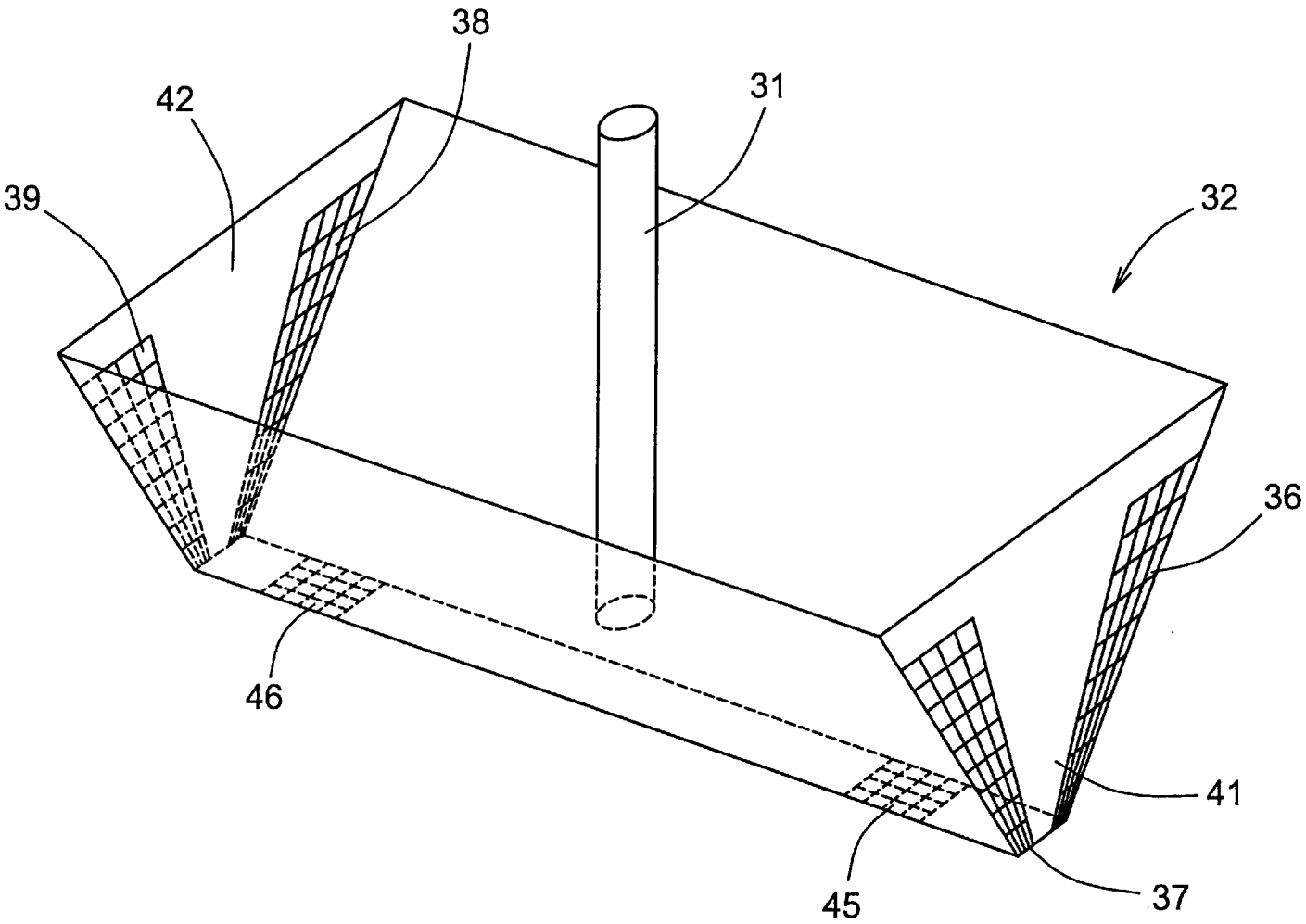
FIG. 3 is a perspective view of a nozzle and distributor bag in accordance with the present invention.

FIG. 3 shows a distributor consisting of a nozzle 31 that is identical to the nozzle 17 shown in FIGS. 1*a* and 1*b*. The distributor bag 32, like that of FIGS. 1*a* and 1*b*, has a horizontal cross section in the shape of an elongated rectangle, but a vertical cross section (i.e., the cross section parallel to the short end walls of the caster) in the shape of a trapezoid, wider at the top and sloping inward toward the bottom. The four lateral windows or openings 36, 37, 38, 39 are on the two end walls 41, 42. Each window is oblong in shape and slopes inward toward the bottom, as do the two long side walls 43, 44. The trapezoidal shape of the distributor bag 32 and the slopes of the lateral windows 36, 37, 38, 39 are roughly parallel to the shape of the solid-liquid interface in the solidifying metal, and the streams of molten metal emerging from the windows are sheets of liquid sweeping along the wide faces of the solidification front. These sheets of liquid metal flow transversely across the dendrites of crystallized metal (in the "mushy zone") growing inward from the long walls of the solidified shell, breaking the dendrites into fragments, and distributing the fragments through the liquid metal pool. Also included in the construction of the distributor bag 32 are a pair of bottom windows 45, 46 to direct flow of liquid metal downward for further mixing.

Figure 4:
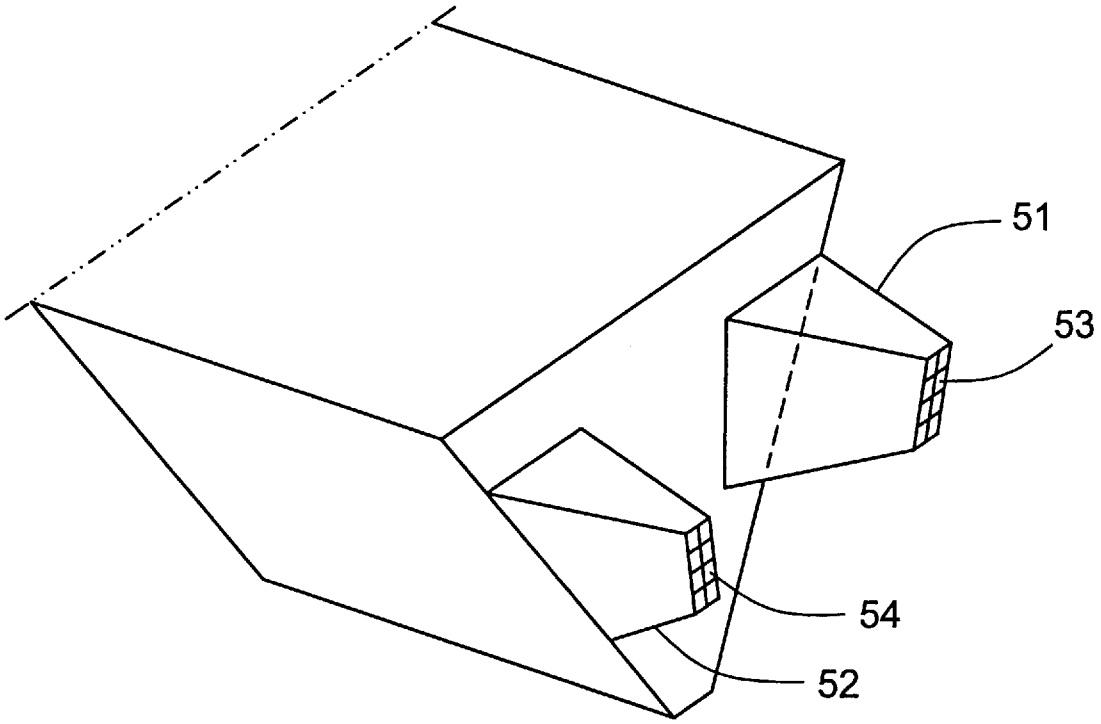
FIG. 4 is a perspective half view of a variation on the distributor bag of FIG. 3.
Figure 5:
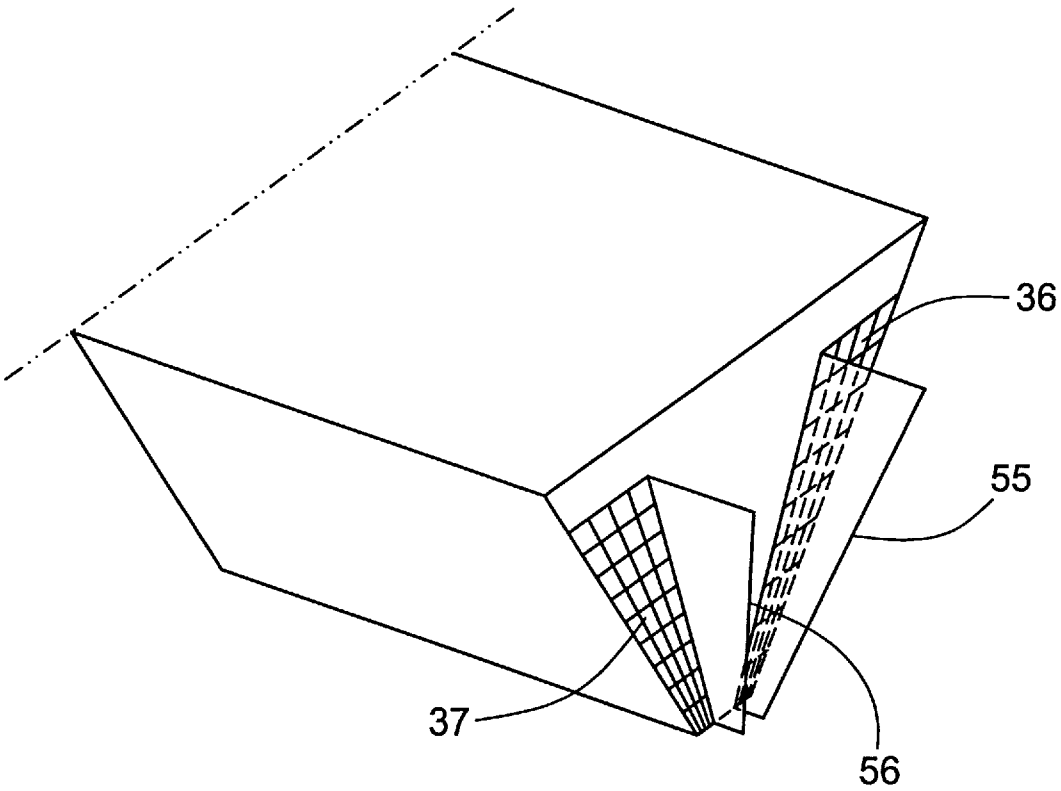
FIG. 5 is a perspective half view of a further variation on the distributor bag of FIG. 3.
Figure 6:
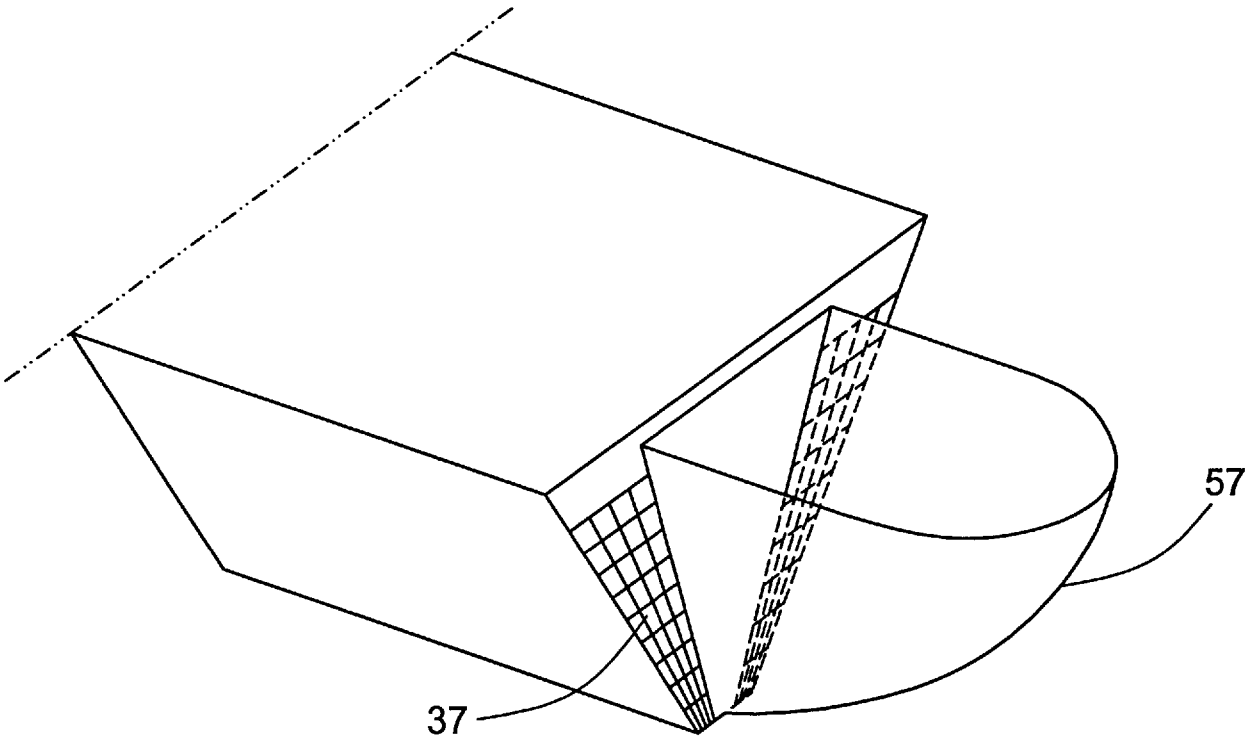
FIG. 6 is a perspective half view of a still further variation on the distributor bag of FIG. 3.

Variations on the distributor bag design of FIG. 3 are shown in FIGS. 4, 5, and 6. In FIG. 4, the elongated lateral windows are replaced by nozzles 51, 52 terminating in smaller openings 53, 54, which direct the flow more accurately in the directions desired and increase the speed of the flow. The desired directions, as indicated above, can be parallel to the bisecting plane (not shown in this drawing) of the caster or they may diverge from the bisecting plane. The distributor bag of FIG. 5 has the same elongated sloping lateral windows 36, 37 as the FIG. 3 design, but further contains baffles or plates 55, 56 that further serve to control the flow direction. These plates can be parallel to the sloping sides of the distributor bag or angled outward to cause the two flow streams to diverge from the bisecting plane (not shown). In FIG. 6, the plates are replaced by a single protruding element 57 or nose, with a curved contour. This can further optimize the flow.

Figure 7A:
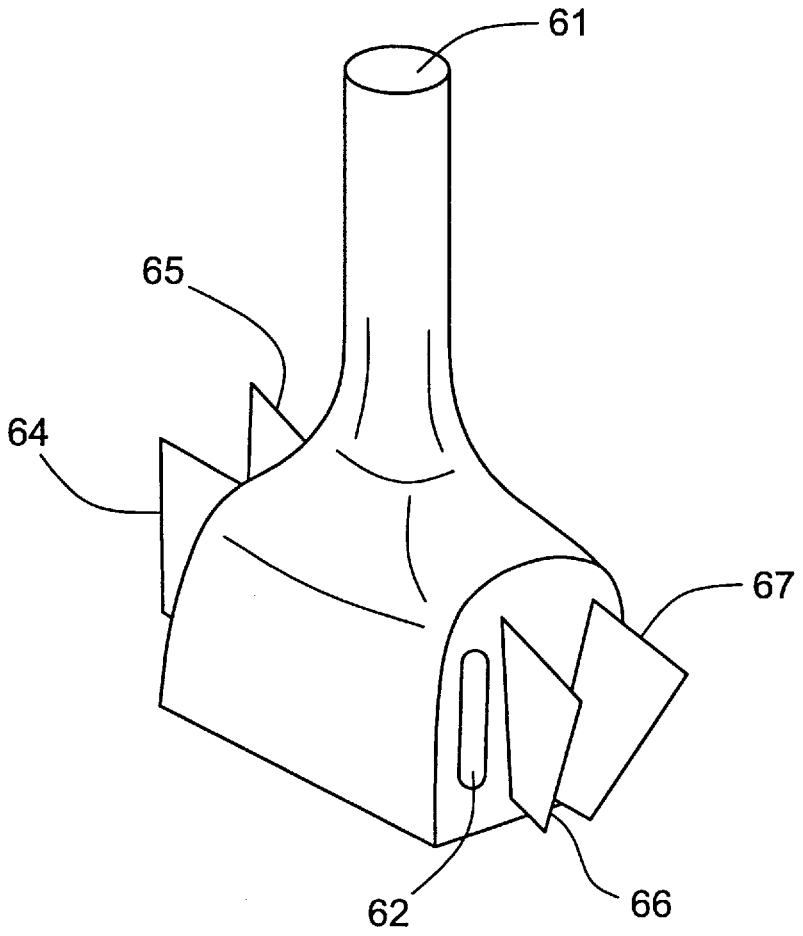
FIGS. 7*a* and 7*b* are perspective and end views, respectively, of a different distributor design in accordance with the present invention.
Figure 7B:
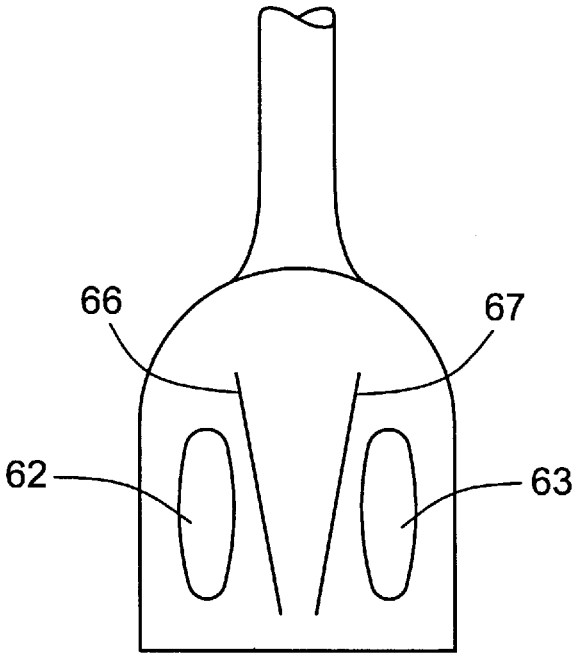
Figure 8:
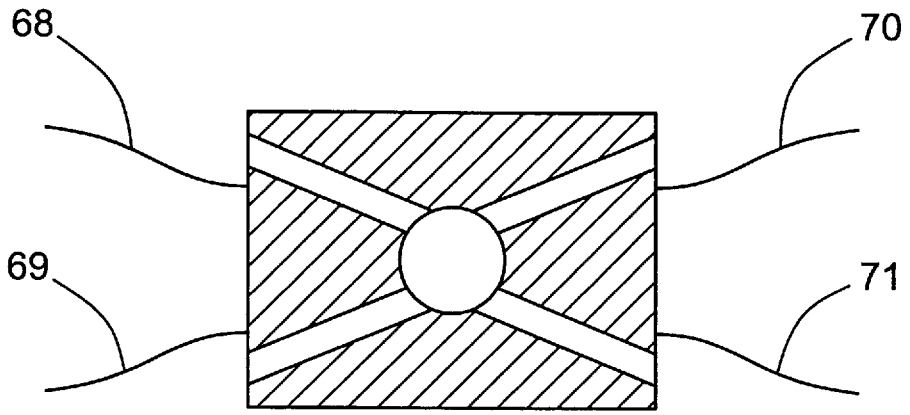
FIG. 8 is a horizontal cross section view of a distributor similar to that of FIGS. 7*a* and 7*b*.

The concepts of this invention can also be implemented without the use of a distributor bag, by shaping the nozzle itself to form the four horizontal streams. While a shaped nozzle of this type without a distributor bag can be used for aluminum, it offers special advantages for steel and other metals whose melting point is higher than that of aluminum. The nozzle, which is preferably of continuous ceramic material, can be of the construction shown in FIGS. 7*a* (perspective view) and 7*b* (end view), for example. The inlet 61 is similar to that of the nozzles in the preceding drawings, and the nozzle is otherwise closed except for four openings occupying positions corresponding to the lateral windows of the distributor bags of the preceding drawings. Two 62, 63 of the four openings are shown in the end view of FIG. 7*b*. Both are elongated, each window having a vertical dimension exceeding its horizontal dimension, thereby producing a broad stream to sweep the solidification front on each side. The shapes and directions of the streams are further controlled by baffles 64, 65, 66, 67, which in this case are angled so that the liquid flows in directions similar to the flows in the trapezoidal distributor bags of the preceding drawings. A variation is shown in FIG. 8, which is a horizontal cross section of a distributor like that shown in FIGS. 7*a* and 7*b*, taken at the level of the discharge openings. This distributor differs in the shapes of the baffles 68, 69, 70, 71, which are S-shaped to direct the flow along the long side walls of the caster toward the corners.

Figure 9A:
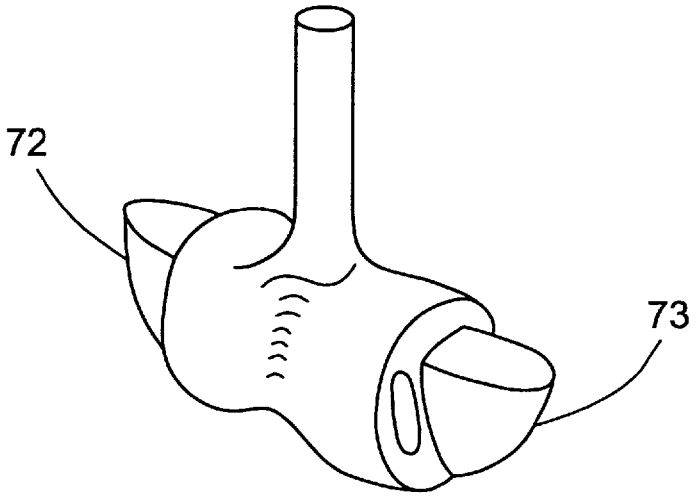
FIGS. 9*a* is a perspective section view of a distributor that is a variation of the distributor of FIGS. 7*a* and 7*b*.
Figure 9B:
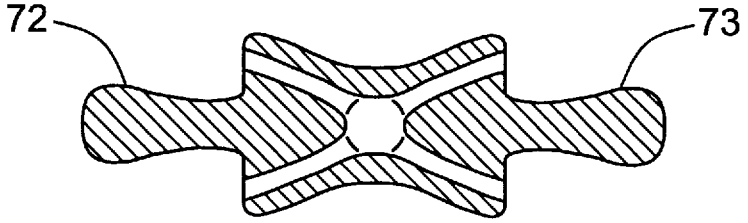
FIGS. 9*b* and 9*c* are alternative cross sections of the distributor of FIG. 9*a*.
Figure 9C:
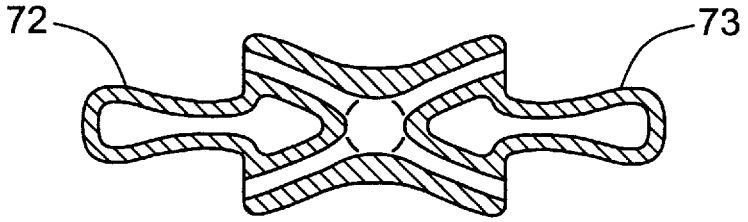

Further variations on the structure of the distributor are shown in FIGS. 9*a*, 9*b*, and 9*c*. In these variations, the baffles of FIGS. 7*a*, 7*b*, and 8 are replaced by protruding elements 72, 73, similar to that shown in FIG. 8. The protruding elements are solid in FIG. 9*b* and hollow in FIG. 9*c*.

Figure 10A:
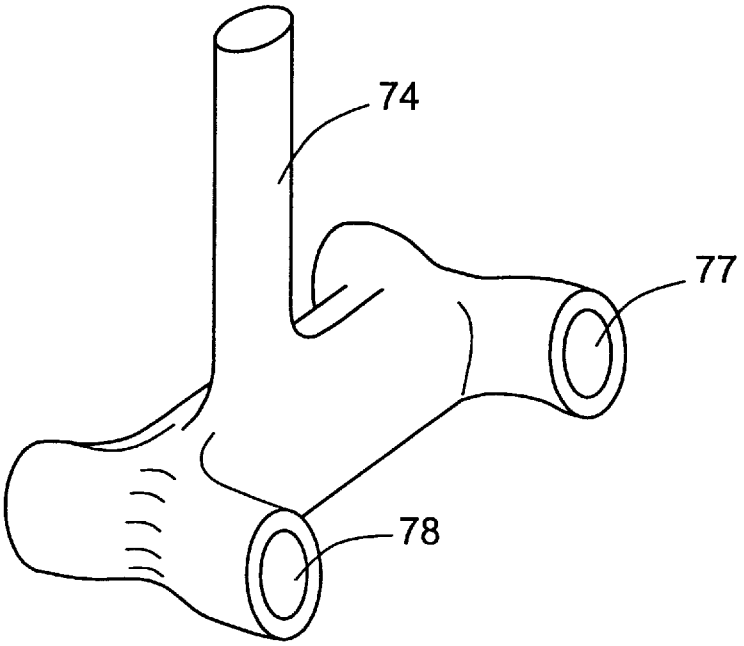
FIGS. 10*a* and 10*b* are perspective and cross section views, respectively, of a still further distributor in accordance with this invention.
Figure 10B:
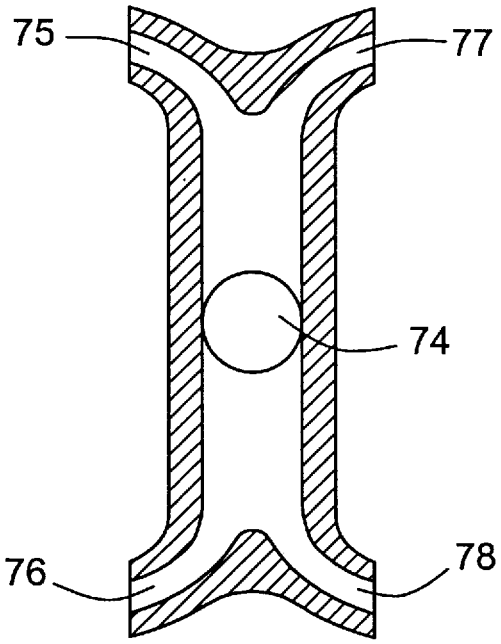

A distributor with a wider spacing between discharging streams flowing in the same direction is shown in FIGS. 10*a* and 10*b*. The location of the inlet 74 is the same as that of FIGS. 7 through 9, and the discharge outlets 75, 76, 77, 78 are similarly located in a common horizontal plane, but are positioned differently with a wider spacing between streams flowing in the same direction and a narrower spacing between steams flowing in opposite directions. The wider spacing places the incoming streams closer to the long side walls of the caster and thereby provides for greater fragmentation of the dendrite crystals, and a broader circulation.

The circulation patterns created by each of the embodiments shown in these figures are illustrated in FIG. 11*a*. This figure is a horizontal cross section of a caster 81 taken at the level of the four horizontal streams leaving from the distributor. The distributor 82 is shown in the center of the caster, and the flow paths of each of the four streams 83, 84, 85, 86 are shown by arrows. Each flow path circulates first along the longitudinal side wall (87 or 88) of the caster toward the corner, then along the short end wall (89 or 90) toward the bisecting plane 91 and back toward the vertical axis 92 of the caster. The prior art flow configuration is shown in FIG. 11*b*. Here the flow paths 93, 94, 95, 96 circulate in the opposite direction. The consequence is that the inflowing metal has lost much of its thermal and kinetic energy before encountering a mushy zone and therefore has a diminished ability to cause fragmentation and to disperse the fragments throughout the liquid pool. In contrast, the circulation pattern of FIG. 11*a* provides an opportunity for the kinetic and thermal energy of the incoming metal to bring fragmentation in the mushy zone close to the metal inflow points.

The circulation patterns of FIG. 11*a* are created by a distributor bag of the structure shown in FIG. 3. Similar circulation patterns are generated by the various configurations of metal delivery apparatus shown in FIGS. 4 through 10.

While the flow paths indicated in FIG. 11*a* are represented by arrows, the flows themselves can be of expanding cross section, spreading out slightly in the vertical plane, the horizontal plane, or both. The degree and direction of expansion can be controlled by the internal contours and dimensions of the discharge outlets, in manners well known among those skilled in the art. The degree of expansion is preferably within about 30° outward from the axis of the port, for a total jet angle of 60°.

Many processes for continuous casting of steel include the injection of argon into the stream of steel flowing through the nozzle. The buoyancy of the argon bubbles imparts a vertical velocity component to the steel leaving the nozzle holes 28, 29 (FIG. 2). The circulation pattern as seen from above remains similar to that of FIG. 11*b*. However, the kinetic and thermal energy of the steel arriving at the end walls of the caster are yet further diminished by the upflow to the near surface region induced by the argon injection. The use of argon in the present invention will similarly add a vertical velocity component to the metal stream. The upflow will be less harmful, however, because the distance that the molten metal must travel to reach the mushy zone in FIG. 11*a* is shorter than the distance to the mushy zone in FIG. 11*b*.

Further control of the force of the metal streams in the present invention can be achieved by the addition of electromagnetic braking applied to the metal streams as they leave the distributor. Electromagnetic braking is known in the casting industry, and is achieved by the use of electromagnets positioned on opposing sides of the caster. The method of applying the magnets will be the same as they are conventionally used prior to this invention.

Figure 12:
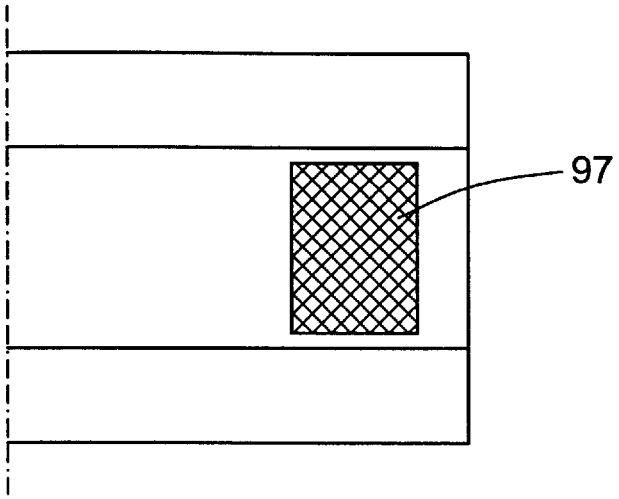
FIG. 12 is a view of the bottom of a distributor bag similar to that of FIG. 3.
Figure 13:
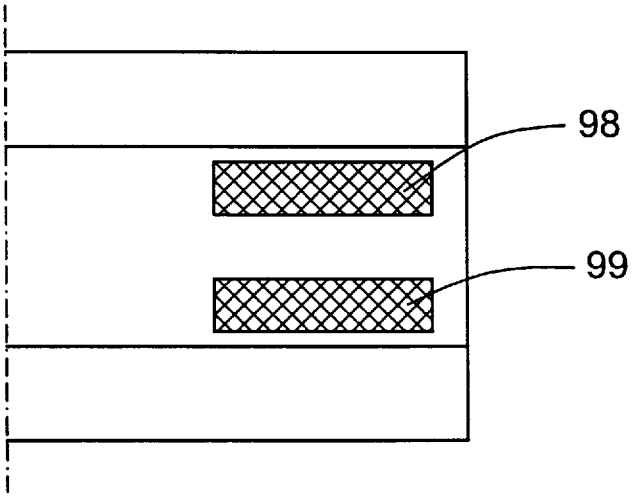
FIG. 13 is a view of the bottom of a further distributor bag similar to that of FIG. 3.

Returning to the distributor of FIG. 3, a view of the bottom of the distributor bag is shown in two alternate configurations in FIGS. 12 and 13, respectively, each showing only one half of the distributor bag. These figures show two alternate arrangements of the bottom window or opening. In FIG. 12, only one bottom opening 97 is shown, the bag itself containing two such bottom openings in total. In FIG. 13, two bottom openings 98, 99 are shown, the bag containing four such bottom openings in total. In certain cases, the configuration of FIG. 13 is superior by improving the circulation pattern beneath the distributor. Similar arrangements for the bottom openings can be made in the distributors of FIGS. 7 through 11.

The distributors are fabricated of suitable materials such as those commonly used for distributor bags and nozzles of the prior art. In general, any material capable of withstanding the temperatures and stresses encountered in continuous casting operations for the particular metal being cast can be used. The same is true of all operating conditions, the selection of which will be subject to the same considerations of processes and equipment of the prior art.

The foregoing is offered primarily for purposes of illustration. The optimal distributor configuration for any particular process will depend on the metal being cast, the degree of improvement of the casting that is being sought, and other details such as the geometry of the casting. It will be readily apparent to those skilled in the art that modifications and variations in the shapes, dimensions, number and arrangement of nozzle ports, and other parameters of the methods and structures disclosed herein can be made without departing from the spirit and scope of the invention.

We claim:

1. A distributor for distributing a stream of molten metal as said metal is being poured into a caster for continuous casting, said caster being elongate and vertically arranged and having a horizontal cross section that is oblong in shape, said distributor comprising:

a receptacle having a central vertical axis and first and second orthogonal bisecting planes intersecting at said central vertical axis, said receptacle containing an inlet to receive molten metal and exactly four horizontal outlets to discharge molten metal thus received, said four horizontal outlets positioned and shaped to discharge said molten metal in a common horizontal plane and in four directions symmetrically arranged relative to said first bisecting plane and relative to said second bisecting plane and not intersecting either said first bisecting plane or said second bisecting plane.

2. A distributor in accordance with claim 1 in which said four horizontal outlets define the four corners of a rectangle whose length is greater than its width.

3. A distributor in accordance with claim 1 in which said four horizontal outlets are each positioned and shaped to discharge said molten metal in directions parallel to one of said bisecting planes.

4. A distributor in accordance with claim 1 in which said four horizontal outlets are each positioned and shaped to discharge said molten metal in directions at acute angles to, and away from, one of said bisecting planes.

5. A distributor in accordance with claim 1 in which each of said four horizontal outlets is an oblong opening having a vertical dimension exceeding its horizontal dimension.

6. A distributor in accordance with claim 1 in which said four horizontal outlets are each positioned and shaped to discharge said molten metal in directions parallel to one of said bisecting planes, and each of said four horizontal outlets is an oblong opening having an elongate axis at an acute angle relative to said one bisecting plane sloping inward toward said plane.

7. A distributor in accordance with claim 1 further comprising baffles projecting from external surfaces of said receptacle directing flows discharged from adjacent horizontal outlets away from each other.

8. A distributor in accordance with claim 1 in which said four horizontal outlets are defined as lateral outlets and said receptacle further contains additional outlets defined as bottom outlets and positioned and shaped to discharge molten metal substantially straight downward from said receptacle.

9. A distributor in accordance with claim 8 in which said bottom outlets are symmetrically arranged relative to said first and bisecting planes.

10. A distributor in accordance with claim 8 in which said bottom outlets are two in number.

11. A distributor in accordance with claim 8 in which said bottom outlets are four in number.

12. A distributor in accordance with claim 8 in which said bottom outlets are four in number and define the four corners of a rectangle symmetrically arranged relative to said first and bisecting planes.

13. A method for feeding molten metal to a caster for continuous casting, said caster being elongate and vertically arranged with a vertical axis and a horizontal cross section, said horizontal cross section bounded by two longitudinal sides and two lateral sides of lesser length than said longitudinal sides, said horizontal cross section divisible into four quadrants by orthogonal bisecting planes parallel to said sides, said method comprising:

dividing said molten metal into a plurality of streams comprising exactly four horizontal streams, and directing said four horizontal streams away from said vertical axis in circulating patterns with flow directions in a common horizontal plane inside said caster, one circulating pattern within each quadrant, each circulating pattern flowing away from said vertical axis along a longitudinal side and returning toward said vertical axis adjacent to the bisecting plane parallel to said longitudinal sides.

14. A method in accordance with claim 13, comprising directing said four horizontal streams in directions substantially parallel to said longitudinal sides.

15. A method in accordance with claim 13, comprising directing said four horizontal streams in directions at acute angles to, and toward, said longitudinal sides.

16. A method in accordance with claim 13, comprising forming said four horizontal streams into flows with flow cross sections oblong in shape, each cross section having a vertical dimension exceeding its horizontal dimension.

17. A method in accordance with claim 16 in which each flow cross section has an elongate axis sloping inward toward the bisecting plane parallel to said longitudinal sides.

18. A method in accordance with claim 13 in which said plurality of streams further comprises vertical streams directed downward from said common horizontal plane.

19. A method in accordance with claim 18 in which said vertical streams are two in number.

20. A method in accordance with claim 18 in which said vertical streams are four in number.

* * * * *